US008851172B1

(12) United States Patent
Dudzinski

(10) Patent No.: US 8,851,172 B1
(45) Date of Patent: Oct. 7, 2014

(54) HIGH STRENGTH, LOW DENSITY METAL MATRIX COMPOSITE BALL SEALER

(75) Inventor: Paul A. Dudzinski, New Haven, CT (US)

(73) Assignee: Parker-Hannifin Corporation, Cleveland, OH (US)

( * ) Notice: Subject to any disclaimer, the term of this patent is extended or adjusted under 35 U.S.C. 154(b) by 477 days.

(21) Appl. No.: 12/854,476

(22) Filed: Aug. 11, 2010

Related U.S. Application Data

(60) Provisional application No. 61/233,168, filed on Aug. 12, 2009.

(51) Int. Cl.
*E21B 33/13* (2006.01)

(52) U.S. Cl.
USPC ..... 166/284; 166/193

(58) Field of Classification Search
USPC ..... 166/284, 193
See application file for complete search history.

(56) References Cited

U.S. PATENT DOCUMENTS

| | | | | |
|---|---|---|---|---|
| 2,254,246 | A | 9/1941 | Scaramucci | |
| 2,754,910 | A | 7/1956 | Derrick et al. | |
| 2,933,136 | A * | 4/1960 | Ayers et al. | 166/284 |
| 4,102,401 | A | 7/1978 | Erbstoesser | |
| 4,244,425 | A | 1/1981 | Erbstoesser | |
| 4,410,387 | A | 10/1983 | Halkerston et al. | |
| 4,421,167 | A | 12/1983 | Erbstoesser et al. | |
| 4,488,599 | A | 12/1984 | Graham et al. | |
| 4,505,334 | A | 3/1985 | Doner et al. | |
| 4,573,517 | A | 3/1986 | Booth et al. | |
| 5,322,109 | A | 6/1994 | Cornie | |
| 5,484,882 | A * | 1/1996 | Takada et al. | 528/361 |
| 5,553,658 | A | 9/1996 | Cornie | |
| 5,983,973 | A | 11/1999 | Cornie | |
| 6,148,899 | A | 11/2000 | Cornie et al. | |
| 2006/0086434 | A1 | 4/2006 | Cornie et al. | |
| 2007/0007007 | A1 | 1/2007 | Themig et al. | |
| 2007/0169935 | A1 | 7/2007 | Akbar et al. | |
| 2009/0255674 | A1 | 10/2009 | Boney et al. | |

FOREIGN PATENT DOCUMENTS

| | | |
|---|---|---|
| WO | 2009050681 A2 | 4/2009 |

* cited by examiner

*Primary Examiner* — Nicole Coy
(74) *Attorney, Agent, or Firm* — John A. Molnar, Jr.

(57) ABSTRACT

High strength, low density ball sealer for sealing openings in oil or gas wells, such as perforations formed through the well casing or openings formed through slidable packers or sleeves received within a tubing string in the well, from the flow of a fluid injected into the well. The ball sealer is formed as having an inner core, and a metal matrix composite layer surrounding the core.

22 Claims, 4 Drawing Sheets

HIGH STRENGTH, LOW DENSITY METAL MATRIX COMPOSITE BALL SEALER

CROSS REFERENCE TO RELATED APPLICATIONS

The present application claims the benefit of the filing date of U.S. Provisional Application Ser. No. 61/233,168, filed Aug. 12, 2009, the disclosure of which is incorporated herein by reference in its entirety.

FIELD OF THE INVENTION

The present invention relates broadly to ball sealers used for sealing perforations in the casings of wellbores such as during stimulation operations.

BACKGROUND OF THE INVENTION

As described in U.S. Pat. Nos. 2,254,246; 4,244,425; 4,410,387; and 4,505,334; U.S. Pat. Appln. Publ. 2009/0255674, and Intl. Appln. No. WO 2009/050681, it is common practice in completing oil and gas wells to set a string of pipe, also known as a casing, in the wellbore. The outside of the casing typically is surrounded by concrete sheath. Perforations are provided through the sheath and casing to allow fluid to flow between the interior of the casing and the geological formations surrounding the sheath. This structure of the well permits the flow of fluid between the casing and the formations to be limited to selected zones or strata. The well operator determines from which zone or zones hydrocarbons are to be collected from during recovery operations, or into which fluids are to be injected during a stimulation operation such as fracturing or "fracking," and then perforates the sheath and casing in the area of those zones.

Ball sealers are spheres which are sized to be slightly larger than the openings of the perforations inside the casing. They are employed to seal the openings of certain of the perforations to thereby mechanically divert fluid flow from those perforations to other perforations in the wellbore.

Ball sealers and are incorporated in the working fluid used in the fracturing or other treatment operation, and are injected into the wellbore with the fluid. The balls are carried to the perforations by the fluid flow and seat in the openings of the perforation wherein they are held in place by differential pressure. The effectiveness of the seal depends on factors such as the differential pressure across the perforation, the geometry of the perforation, and physical characteristics of the ball sealer.

As additionally described in U.S. Pat. Appln. Publ. No. 2007/0169935 and U.S. Pat. Nos. 2,754,910; 4,102,401; 4,421,167; and 4,488,599, ball sealers, which may be either soluble or non-soluble, are made in a variety of diameters, densities, and compositions to accommodate different wellbore conditions and perforation sizes. Non-soluble ball sealers of the type herein involved generally consist of a rigid solid or hollow core covered by a rubber or other coating.

Presently there is an interest in advancing fracking technology to improve the extraction rates of existing wells. The goal is to be able to use higher pressures and to increase the number of well zones that can be isolated. The key to this advancement is through the development of ball sealers having a higher specific strength, that is, an increase in strength without an increase in weight.

Ball sealers are used in hostile environments and need to be robustly constructed. Ball sealers also need to be buoyant within the working fluid, and therefore are required to be of a density which is within a specific range. This range is relatively low and limits the materials and constructions that can be employed. Those in the field have long struggled to create a ball sealer that is light and strong enough to be buoyant in the working fluid, but strong enough to endure high pressures without distorting or shattering.

Ball sealers initially were used with lower pressures and typically were constructed of high strength plastics. As working pressures increased, ball sealers needed to be constructed from higher strength materials such as a resin-infused syntactic foam core covered with an elastomeric, plastic, or other material. Alternate constructions employed a light-weight, hollow core covered in a skin made of machined aluminum or made by wrapping a high strength filament impregnated with a thermosetting resin. As wellbore working pressures continue to increase, it is to be expected that continued improvements in ball sealers would be well-received by the oil and gas industry.

BROAD STATEMENT OF THE INVENTION

The present invention is directed to a ball sealer construction which is both light weight and high strength. Such construction is particularly adapted for use in high pressure, high temperature hydraulic fracturing operations.

In an illustrative embodiment, the ball sealer of the present invention employs a light-weight, generally spherical core which may be solid, such as a foam, or hollow, and which may be formed of a metal or a non-metal such as a ceramic or quartz. The core forms a base onto which one or more layers of a one or more continuous, high-strength fibers or fiber blends are spherically or otherwise wound to create a preform ball. Following densification of the wound ball to remove excess air and/or binding agents from the fiber layer and to fix the diameter of the ball to a controlled size, the ball then may be placed in a metal infiltration mold. Therein the mold, the fiber layer is infiltrated with molten metal at high temperature and pressure such that the metal impregnates the fiber layer to form a metal matrix composite (MMC) layer which encapsulates the core of the ball. Such structure provides a ball sealer with exceptional strength and stiffness, but with a low specific gravity. Such ball sealer further may incorporate a relatively thin coating, plating, or other outer layer to provide enhanced resistance to chemicals and/or mechanical damage.

The present invention, accordingly, comprises the construction, combination of elements, and/or arrangement of parts and steps which are exemplified in the detailed disclosure to follow. Advantages of the present invention includes a high-temperature, high-pressure ball sealer having substantially isotropic structural properties and an exceptional strength-to-weight ratio. These and other advantages will be readily apparent to those skilled in the art based upon the disclosure contained herein.

BRIEF DESCRIPTION OF THE DRAWINGS

For a fuller understanding of the nature and objects of the invention, reference should be had to the following detailed description taken in connection with the accompanying drawings wherein.

Figure 1:
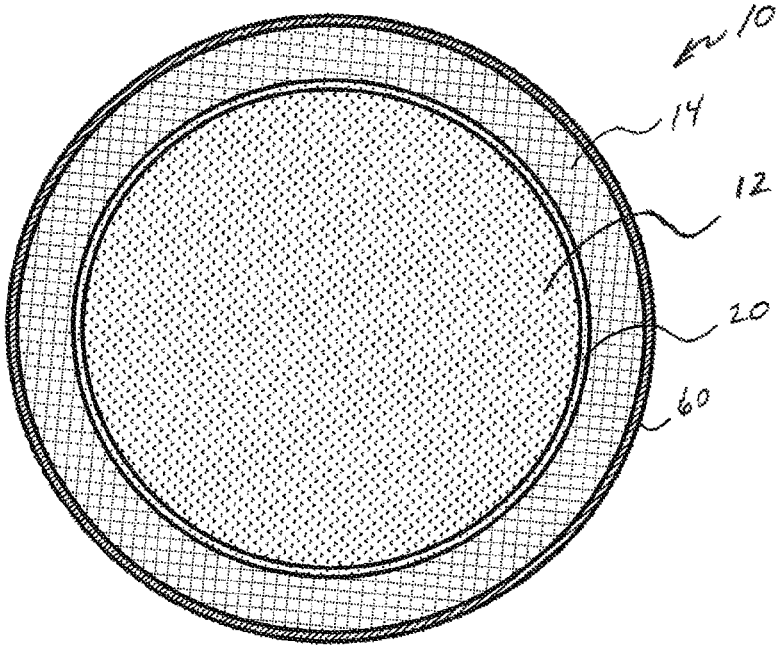
FIG. 1 is a cross-sectional view of a representative ball sealer in accordance with the present invention which includes a solid core over which a fiber layer is wound and impregnated with a metal to form a metal matrix composite (MMC) layer.

The drawings will be described further in connection with the following Detailed Description of the Invention.

DETAILED DESCRIPTION OF THE INVENTION

Certain terminology may be employed in the description to follow for convenience rather than for any limiting purpose. For example, the terms "forward," "rearward," "right," "left," "upper," and "lower" designate directions in the drawings to which reference is made, with the terms "inward," "interior," "inner," or "inboard" and "outward," "exterior," "outer," or "outboard" referring, respectively, to directions toward and away from the center of the referenced element, and the terms "radial" or "horizontal" and "axial" or "vertical" referring, respectively, to directions, axes, planes perpendicular and parallel to the central longitudinal axis of the referenced element. Terminology of similar import other than the words specifically mentioned above likewise is to be considered as being used for purposes of convenience rather than in any limiting sense.

In the figures, elements having an alphanumeric designation may be referenced herein collectively or in the alternative, as will be apparent from context, by the numeric portion of the designation only. Further, the constituent parts of various elements in the figures may be designated with separate reference numerals which shall be understood to refer to that constituent part of the element and not the element as a whole. General references, along with references to spaces, surfaces, dimensions, and extents, may be designated with arrows or underscores.

Referring to the figures wherein corresponding reference characters are used to designate corresponding elements throughout the several views with equivalent elements being referenced with prime or sequential alphanumeric designations, an illustrative ball sealer in accordance with the present invention is depicted generally at 10 in FIG. 1. Such ball sealer 10 is formed of an inner core, 12, which is encapsulated in or otherwise covered or surrounded by a layer, 14, of a metal matrix composite (MMC) material formed of one or more layers of one or more continuous fibers wound over core 12 which are impregnated with a metal or metal alloy. Core 12 is shown to be generally special as is typical, but other geometries should be considered within the scope of the invention herein involved.

In the illustrated embodiment of ball sealer 10, core 12, is formed of a light-weight, generally non-structural material which may be a ceramic foam or a metal foam, either foam having a specific gravity (as compare to water at 1 g/cm$^3$) of between about 0.4-1.5. The ceramic or metal foam material may be cast, molded, machined or otherwise formed to size which, upon curing, cooling or other processing, may have a diameter of between about 1.5-10.5 cm.

Depending upon the material of construction selected for core 12, the desired strength-to-density ratio for ball sealer 10, and the operating conditions in the well, it may be necessary or desirable to seal core 12 to prevent the ingress of molten metal during the infiltration process used to form the MMC layer 14. Such sealing can be effected by applying a layer, shown as the interlayer referenced at 20 in FIG. 1, of a non-porous, refractory grade or other coating to the outside of the core after it is molded and, in the case of a ceramic material, cured. Once fired, such coating forms a generally impervious layer capable of withstanding temperatures of several hundred degrees above the infiltration temperature. Examples of materials which may be used for forming layer 20 are marketed under the name "RX™ Refractory Grade Coating" by RX Chemical Company (Lake Geneva, Wis.) and "Glass Frit 3225-3" by Ferro Corp (Cleveland, Ohio).

Figure 2:
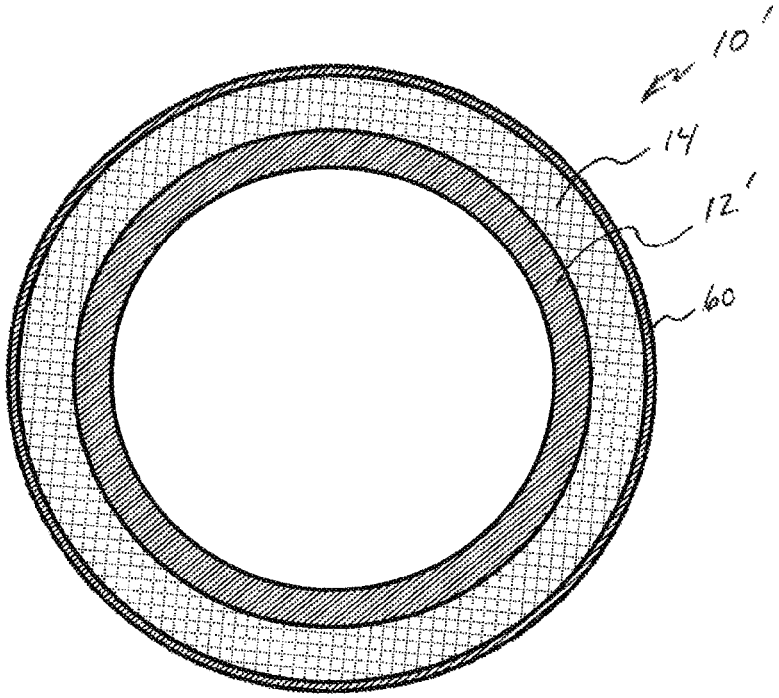
FIG. 2 is a cross-sectional view of an alternative embodiment of a ball sealer in accordance with the present invention which includes a hollow core.

Looking additionally to FIG. 2, ball sealer 10 of FIG. 1 reappears at 10' as alternatively being constructed as having a hollow core 12'. As with the solid core 12, the hollow core 12' must be both sufficiently strong and inert to withstand the metal infiltration process for forming the MMC layer 14 without structural failure and without reacting detrimentally with the molten metal. The hollow core 12' must also possess sufficient strength to resist the forces induced thereon during the metal casting operation, and must be sufficiently inert to avoid detrimental interaction with the molten metal. Suitable materials for forming hollow core 12' include stainless steels (SS), such as austenitic 316L, and fused quartz. In the case of a metal core 12', two hemispheres may be joined such as by welding to form a sphere. In the case of a fused quartz core 12', balls may be formed by blow-molding molten quartz. Properly sized, such as having a wall thickness of between about 0.05-0.5 cm depending upon the material, a hollow core 12' can be designed to achieve the same overall specific gravity as a solid core 12 as is illustrated below in Table 1 wherein the properties of hollow and solid core materials are compared.

TABLE 1

| Diameter (cm) | Wall Thickness (cm) | Material | Specific Gravity | Weight (g) | Core Type |
|---|---|---|---|---|---|
| 4.00 | N/A | Ceramic[1] | 0.70 | 23.5 | Solid |
| 4.00 | 0.06 | SS 316L | 8.03 | 23.5 | Hollow |
| 4.00 | 0.24 | Fused Quartz | 2.20 | 23.5 | Hollow |

[1]Castable Alumina Silica Foam, ResCor ™ 740, Cotronics Corp., Brooklyn, NY

Figure 3:
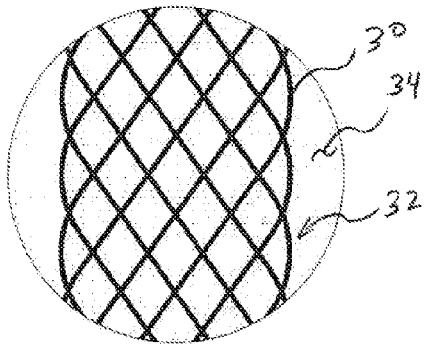
FIG. 3 is a depiction of a winding pattern for winding the fiber layer over the core to form a pre-form.

In the case of either a solid core 12 (FIG. 1) or a hollow core 12' (FIG. 2), MMC layer 14 may be formed by spherically or otherwise winding in one or more layers one or more ends of, preferably, a continuous monofilament or multi-filament, i.e., yarn, strand, cord, roving, thread, tape, or ply, fiber. The fiber, which may be the same or different in each of the layers, generally may be considered as high-strength such as carbon, alumina, or boron, or a blend or combination of such fibers, or a blend or combination of such fibers with other types of fibers. With momentary reference to FIG. 3, the fiber or fibers, one of which is referenced at 30, forming each of the one or more fiber layers, one of which is referenced at 32, which in turn comprise the MMC layer 14 may be spherically or otherwise wound around the coated or uncoated outer surface, 34, of the core 12 or 12' in a regular winding pattern as shown, and to achieve a consistent thickness of the fiber layer 32. Such regular winding pattern, consistent thickness, and use of continuous fibers result in a ball sealer 10 which is stronger and has more uniform properties than would be obtained with a random winding pattern or with the use of randomly dispersed short, i.e., staple, fibers.

The use of different fibers in different layers 32 and/or in blends or combinations within a layer 32 allows for the mechanical properties of the ball sealer 10 to be optimized. For example, carbon fiber may be used to provide high bulk strength with alumina fiber being wound with or over the carbon fiber to provide increased shear strength.

Figure 4A:
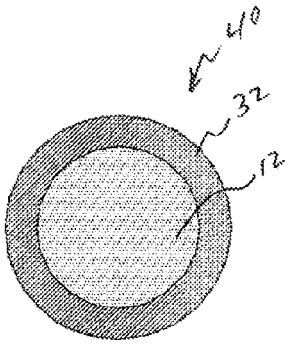
FIGS. 4A-C illustrate a pre-from of the ball sealer of the present invention being densified and metal infiltrated.

Following the winding of the one or more fiber layers 32, the wound core 12, now shown as the pre-form referenced at 40 in FIG. 4A, may be treated with a binding agent such as a high molecular weight polyethylene glycol (PEG) having a relatively low melting point (~63° C.). Such agent is soluble in water at room temperature and may be applied such as by spraying, brushing, or dipping as a solution to saturate the outer fiber layers 32 such as described in U.S. Pat. Appln. Publ. 2006/0086434. Following the application of the binding agent, the pre-form may be dried in a drying oven at a temperature above the melting point of the agent.

Figure 4B:
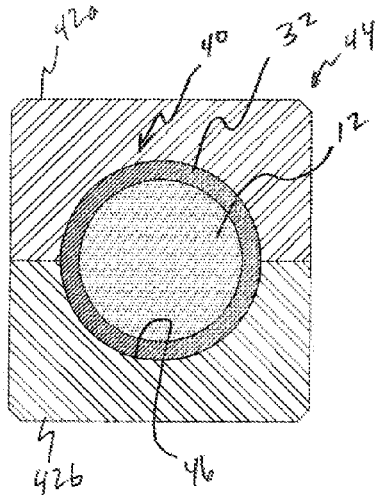

Following drying, the pre-form 40 with the so treated fiber layers 32 may be densified both to remove excess air and/or binding agents from the layers 32, and to size the perform 40. As shown in FIG. 4B such densification may be effected by placing pre-form 40 between the halves 42*a* and 42*b* of a sizing mold, referenced generally at 44. The outside of the pre-form 40 and/or the interior, 46, of the sizing mold 44 may be treated with additional agent such as in a powder form to assist in the release of the pre-form 40 from the mold 44. By densifying the pre-form 40, its diameter may be accurately sized to fit in a casting mold (FIG. 4C) such that the MMC layer 14 (FIGS. 1 and 2) may be formed with a consistent thickness. Densification also provides for a stronger ball sealer by aiding in the removal of voids in the fiber layers 32 which may be caused by air pockets or other inclusions, and, ultimately, by increasing the volume fraction of fibers in the MMC layer 14.

Figure 4C:
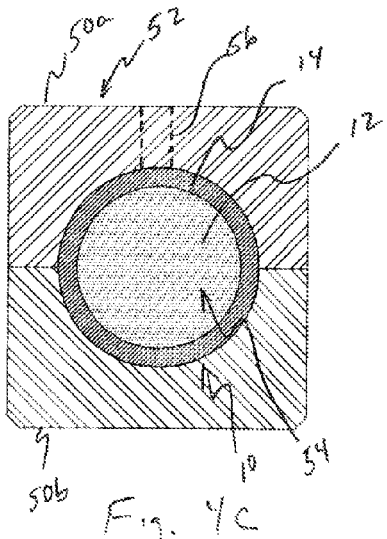

As shown in FIG. 4C, for casting the MMC layer 14, the densified pre-form 40 from FIG. 4B may be placed between the halves 50*a* and 50*b* of a casting mold, referenced generally at 52, for the infiltration into the fiber layers 32 (FIG. 4B) of the metal matrix component of the metal-fiber composite material. After being heated to a temperature above its liquidus temperature, the infiltrated metal may be admitted in a molten state into the cavity, 54, of casting mold 52 through a sprue or other passageway, 56. The molten metal or metal alloy may be cast or otherwise infiltrated into the fiber layers 32 to so form the ball sealer 10 or 10' with or without an externally applied pressure. Suitable infiltration metals include aluminum, bronze, beryllium, chromium, cobalt, copper, gold, iron, steel, magnesium, nickel, lead, tin, and zinc, and alloys and combinations thereof. The casting and pressure casting of MMC materials elsewhere is described in U.S. Pat. Nos. 4,573,517; 5,322,109; 5,553,658; 5,983,973; and 6,148,899.

After infiltration, the ball sealer 10 or 10' may be heat-treated to optimize the material properties of the metal matrix component of the MMC layer 14. Such treatment may include stabilizing, annealing, and/or age hardening processes.

Lastly, the ball sealer 10 or 10' may be machined to final size and surface finished using conventional techniques such as turning or spherical grinding. As cast or as machined or otherwise finished to size, MMC layer 14 may have a thickness of between about 0.1-2.6 cm, with the ball sealer 10 (FIG. 1) or 10' (FIG. 2) thus formed having an overall diameter of between about 2.6-11.5 cm.

Since the MMC layer 14 is electrically-conductive, a final coating or other outer layer, referenced at 60 in FIGS. 1 and 2, optionally may be applied to the layer 14 such as by electrodeposition or thermal spray. Such layer 60 may be applied as needed to provide enhanced resistance to the corrosive media typically used in fracking fluids or found in sour gas well environments, as well as to provide increased resistance to wear or mechanical damage during use. Coatings for layer 60 include metal, metal alloys, and ceramics which may be thermal spray materials such as aluminum oxide, tungsten carbide, and MCrAlY alloy, and electroplate materials such as nickel, chrome, zinc, and cobalt-chrome-carbide. Layer 60 alternately be provided as a thin layer of a plastic or other polymeric material such as polyethylene, polytetrafluoroethylene (PTFE), or polybenzimidazole (PBI) to improve the sealing properties of the ball sealer.

Figure 5:
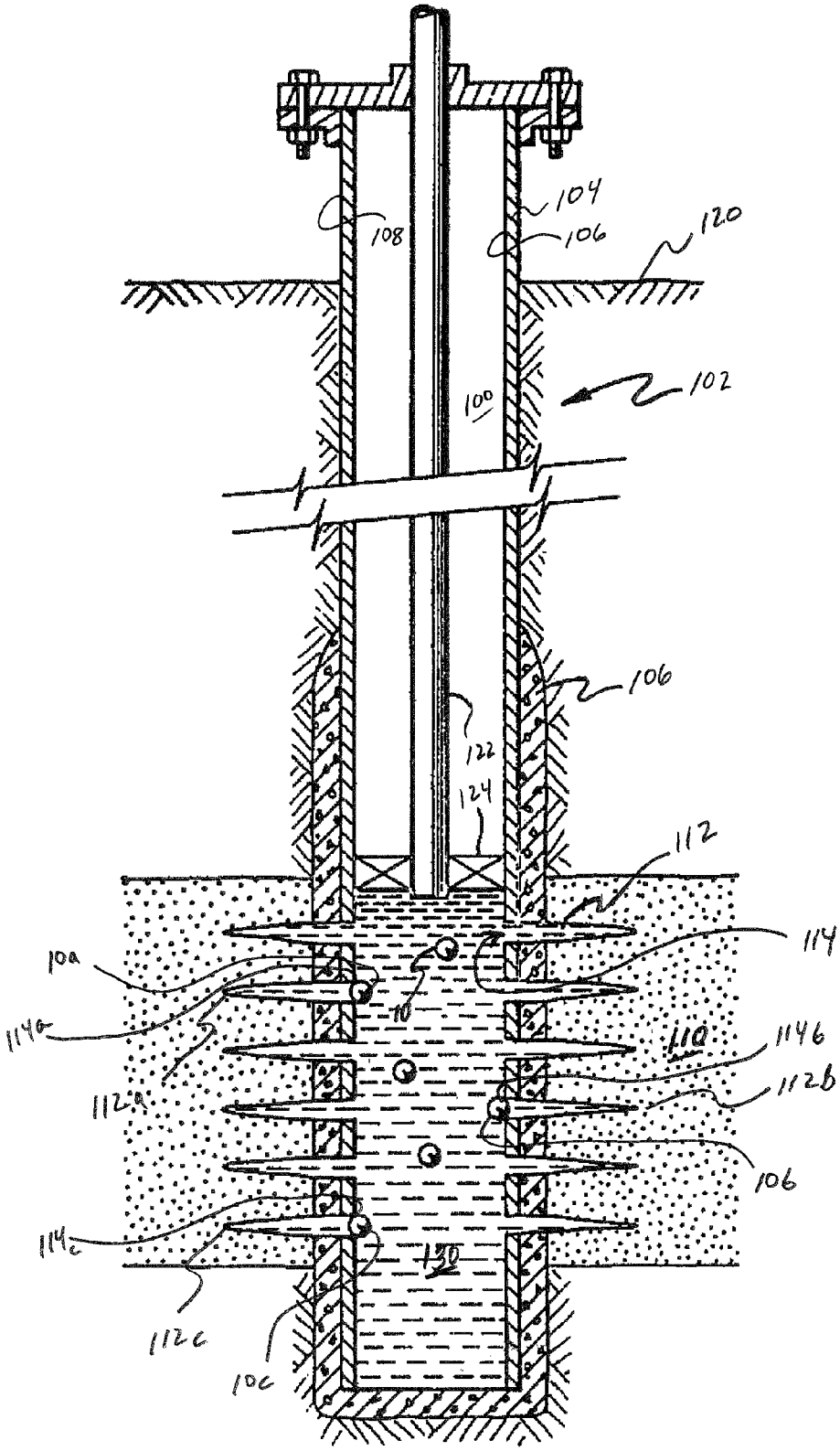
FIG. 5 is a cross-section view of an oil or gas well installation showing the use of the ball sealer of the present invention in an illustrative fracturing operation.

The use of the ball sealers of the present invention is illustrated in FIG. 5 showing a charge of ball sealers 10 being injected into the wellbore, 100, of an oil well, 102. Well 102 includes a casing 104 having an interior, 106, which defines the wellbore 100. The exterior, 108, of the casing 104 is surrounded by a concrete sheath, 106.

Fluid communication between the casing 106 and the producing strata, 110, is provided by a series of perforations, one of which is referenced at 112. Each the perforations 112 extends from, for example, a generally circular opening, 114, in the casing interior 106, through the casing 104 and sheath 106, and into the producing strata 110.

Hydrocarbons flowing out of the producing strata 110 through the perforations 112 and into the wellbore 100 are transported to the surface, 120, through a length of production tubing, 122. A packer, 124, may be installed near the lower end of the length of the production tubing 122 and above the perforations 112 to effect a pressure seal between the production tubing 122 and the casing 104.

During stimulation operations like hydraulic fracturing when fluid, 130, is injected into the well 102, the direction of the fluid flow through the perforations 112 is reversed. In such operations, the ball sealers 10 are injected into the wellbore 100 with the fluid 130. Ball sealers 10, if having a specific gravity less than that of the fluid 130, will sink at a relatively low velocity notwithstanding the drag force of the fluid. Consequently, the ball sealers 10 or 10' of the present invention typically may be designed to have a specific gravity (as compare to water at 1 g/cm$^3$) of between about 1.0 to 2.0.

During fluid injection ball sealers 10 will be carried downward toward the perforations 112*a-c* which are assumed to be experiencing the highest flow rates of the fluid 130. The ball sealers 10*a-c* preferentially move towards the those perforations 112*a-c* and ultimately seat in the corresponding openings 114*a-c* thereof and are held therein by the fluid pressure differential between the wellbore 100 and the strata 110. Ball sealers 10 preferably are sized relative to the openings 114 to substantially seal and close the openings when seated thereon such that the flow of the fluid 130 is diverted to the other openings 114. The ball sealers 10*a-c* remain seated in the openings 114*a-c* until such time as the pressure differential is reversed and the ball sealers are released.

Figure 6:
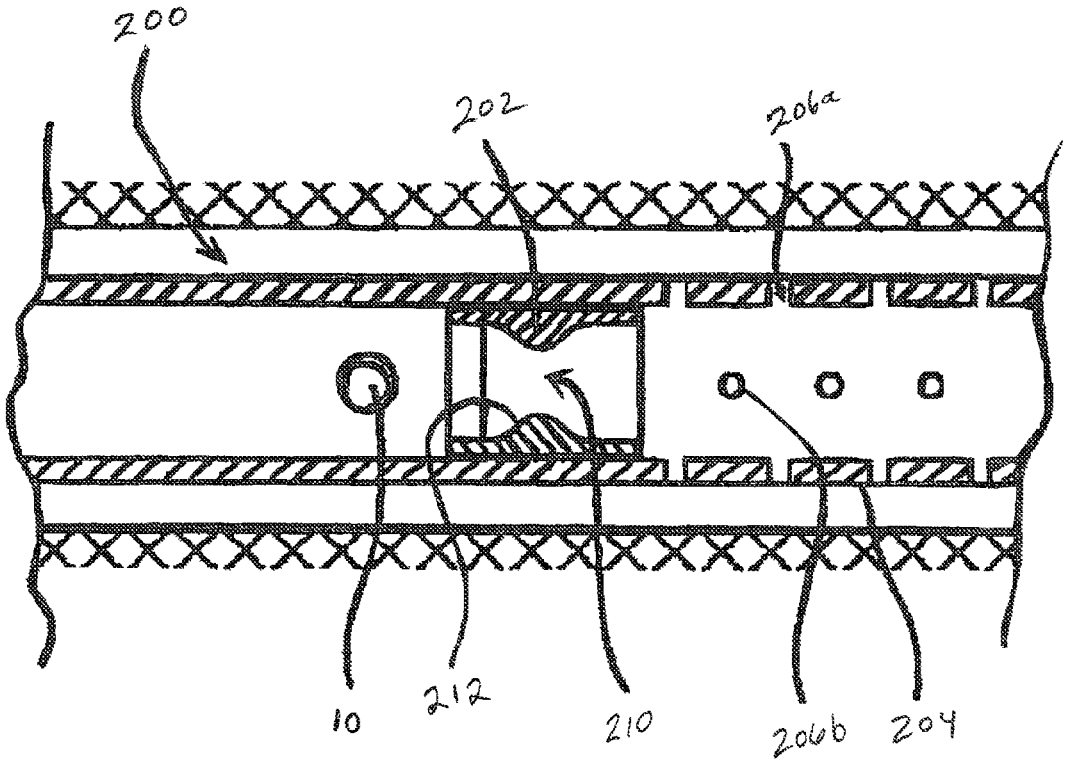
FIG. 6 is a cross-section view of a section of a horizontal wellbore showing the use of the ball sealer of the present invention in an illustrative open hole, multistage fracturing operation.

The ball sealers of the present invention also may be used to seal openings in other well structures or components such as the sleeves or packers used in newer stimulation operations such as open hole, multistage fracturing which is further described in U.S. Pat. Appln. Publ. No. 2007/0007007. With reference to FIG. 6, such operation, which typically is employed in horizontal wellbores, a section of which is referenced at 200, utilizes a slidably movable packer or sleeve, 202, to isolate sections of a tubing string, 204, having a series of perforations, two of which are referenced at 206*a-b*, which may be distributed in different zones along the tubing string

204. Packer 202 has a passageway, referenced at 210, therethrough which narrows to form an internal opening, 212, which may be sealed by ball sealer 10 of the present invention seating therein responsive to the flow of an injection or other fluid in the wellbore 200.

As it is anticipated that certain changes may be made in the present invention without departing from the precepts herein involved, it is intended that all matter contained in the foregoing description shall be interpreted as illustrative and not in a limiting sense. All references including any priority documents cited herein are expressly incorporated by reference.

What is claimed is:

1. A high strength, low density ball sealer for sealing an opening in a well from the flow of a fluid in the well, the fluid having a specific gravity, and the ball sealer comprising:

an inner core; and a metal matrix composite layer surrounding the core, the metal matrix composite layer comprising at least one fiber wound in at least one fiber layer over the core, the fiber layer being impregnated with a metal or metal alloy, wherein the ball sealer has a specific gravity less than the specific gravity of the fluid, and wherein the ball sealer is sized to seat in the opening.

2. The ball sealer of claim 1 wherein the fiber is a continuous fiber.

3. The ball sealer of claim 1 wherein the fiber is selected from the group consisting of carbon, alumina, and boron fibers, and blends and combinations thereof.

4. The ball sealer of claim 1 wherein the metal or metal alloy is selected from the group consisting of aluminum, bronze, beryllium, chromium, cobalt, copper, gold, iron, steel, magnesium, nickel, lead, tin, zinc, and alloys and combinations thereof.

5. The ball sealer of claim 1 wherein the core is solid.

6. The ball sealer of claim 5 wherein the core is formed of a material comprising a ceramic or metal foam.

7. The ball sealer of claim 1 wherein the core is hollow.

8. The ball sealer of claim 7 wherein the core is formed of a material comprising a metal or fused quartz.

9. The ball sealer of claim 1 having a specific gravity of between about 1.0-2.0.

10. The ball sealer of claim 1 wherein the core is generally spherical.

11. The ball sealer of claim 1 further comprising a coating applied to metal matrix composite layer, the coating being selected from the group consisting of metals and metal alloys, ceramics, and plastics.

12. A method of sealing an opening in a well from the flow of a fluid in the well, the fluid having a specific gravity, and the method comprising the step of injecting into the well a ball sealer comprising:

an inner core; and a metal matrix composite layer surrounding the core, the metal matrix composite layer comprising at least one fiber wound in at least one fiber layer over the core, the fiber layer being impregnated with a metal or metal alloy, wherein the ball sealer has a specific gravity less than the specific gravity of the fluid, and wherein the ball sealer is sized to seat in the opening.

13. The method of claim 12 wherein the fiber is a continuous fiber.

14. The method of claim 12 wherein the fiber is selected from the group consisting of carbon, alumina, and boron fibers, and blends and combinations thereof.

15. The method of claim 12 wherein the metal or metal alloy is selected from the group consisting of aluminum, bronze, beryllium, chromium, cobalt, copper, gold, iron, steel, magnesium, nickel, lead, tin, zinc, and alloys and combinations thereof.

16. The method of claim 12 wherein the core of the ball sealer is solid.

17. The method of claim 16 wherein the core is formed of a material comprising a ceramic or metal foam.

18. The method of claim 12 wherein the core of the ball sealer is hollow.

19. The method of claim 18 wherein the core is formed of a material comprising a metal or fused quartz.

20. The method of claim 12 wherein the ball sealer has a specific gravity of between about 1.0-2.0.

21. The method of claim 12 wherein the core of the ball sealer is generally spherical.

22. The method of claim 12 wherein the ball sealer further comprises a coating applied to metal matrix composite layer, the coating being selected from the group consisting of metals and metal alloys, ceramics, and plastics.

* * * * *